US006867725B2

(12) United States Patent
Breeden et al.

(10) Patent No.: US 6,867,725 B2
(45) Date of Patent: Mar. 15, 2005

(54) COMBINATION LOW OBSERVABLE AND THERMAL BARRIER ASSEMBLY

(75) Inventors: Cary T. Breeden, Rancho Cucamogna, CA (US); Vincent M. Ortiz, Hermosa Beach, CA (US); William A. Moore, Rancho Plaos Verdes, CA (US)

(73) Assignee: Northrop Grumman Corporation, Los Angeles, CA (US)

( * ) Notice: Subject to any disclaimer, the term of this patent is extended or adjusted under 35 U.S.C. 154(b) by 79 days.

(21) Appl. No.: 10/453,246

(22) Filed: Jun. 3, 2003

(65) Prior Publication Data

US 2004/0257260 A1 Dec. 23, 2004

(51) Int. Cl.[7] ..... H01Q 17/00
(52) U.S. Cl. ..... 342/1; 342/3; 342/4
(58) Field of Search ..... 342/1, 2, 3, 4

(56) References Cited

U.S. PATENT DOCUMENTS

| | | | | | |
|---|---|---|---|---|---|
| 3,039,172 | A | * | 6/1962 | Egan | 442/76 |
| 3,349,396 | A | * | 10/1967 | Reed | 342/3 |
| 3,349,397 | A | * | 10/1967 | Rosenthal | 342/3 |
| 3,427,619 | A | * | 2/1969 | Beck et al. | 342/3 |
| 4,001,827 | A | * | 1/1977 | Wallin et al. | 342/3 |
| 4,084,161 | A | * | 4/1978 | Manning et al. | 342/2 |
| 4,529,633 | A | * | 7/1985 | Karlsson | 428/17 |
| 5,094,907 | A | * | 3/1992 | Yamamura et al. | 428/293.4 |
| 5,250,950 | A | | 10/1993 | Scherrer et al. | 342/2 |
| 5,312,678 | A | * | 5/1994 | McCullough et al. | 442/189 |
| 5,811,359 | A | * | 9/1998 | Romanowski | 442/261 |
| 6,461,432 | B1 | * | 10/2002 | Stash et al. | 118/429 |
| 2003/0164427 | A1 | * | 9/2003 | Glatkowski et al. | 244/158 R |

OTHER PUBLICATIONS

"Phase switched radar absorbers", Tennant, A.; Chambers, B.;Antennas and Propagation Society International Symposium, 2001. IEEE , vol.: 4, Jul. 8–13, 2001 Ps:340–343.*

"Development of nanodispersible film material absorbing microwave radiation", Kukharchik, P.D.; Maly, S.V.; Kurilo, V.S.;Microwaves, Radar and Wireless Communications. MIKON–2000. 13th Int'l Conference on, vol.:3, May 22–24, 2000 pp.:156–166.*

"Fabrication and evaluation of conducting polymer composites as radar absorbers", Wong, T.C.P.; Chambers, B.; Anderson, A.P.; Wright, P.V.;Antennas and Propagation, 1993., Eighth International Conference on, 1993 Ps:934–937 vol. 2.*

* cited by examiner

*Primary Examiner*—John B. Sotomayor
(74) *Attorney, Agent, or Firm*—Louis L. Dachs

(57) ABSTRACT

The invention is a protective cover assembly having at least one part for a surface of a structure. In detail, the invention includes a first flexible layer of heat resistant material bonded to the structure having an outer surface with a radar cross-section reducing shape. A second layer of radar signature reducing material is bonded to outer surface of the first flexible layer and includes 1) a film of conductive material bonded to the first flexible layer; and 2) a film of radar absorbing material bonded to the film of conductive material. A third layer of heat resistant material is bonded to the second layer, the third layer made of a dielectric material having a thickness selected to provide a reduction in the radar cross-section of the cover when combined with the film of radar absorbing material.

10 Claims, 2 Drawing Sheets

FIG. 5
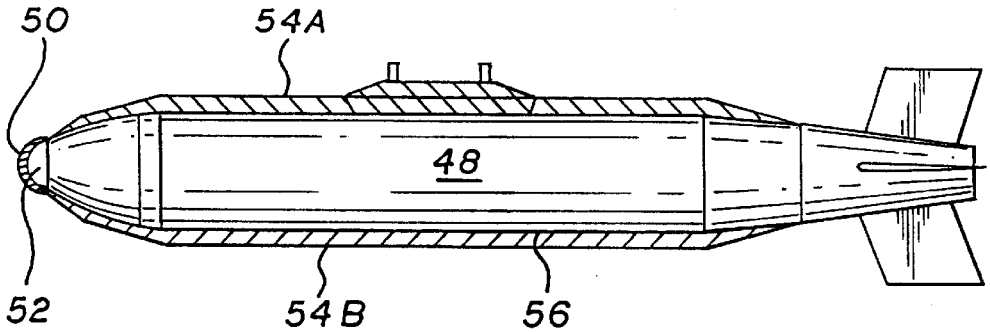
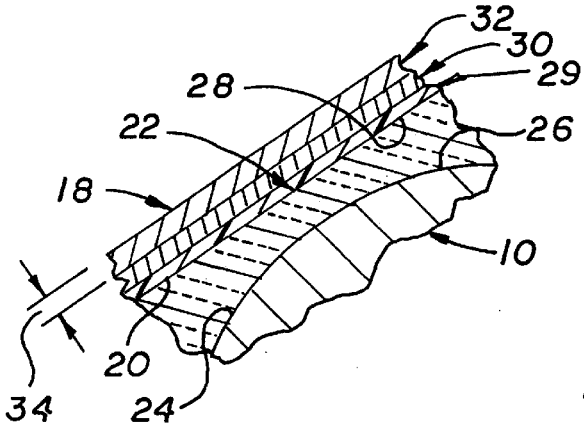
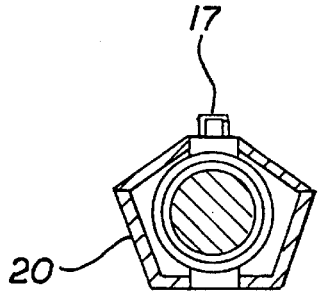
FIG.6
FIG.3
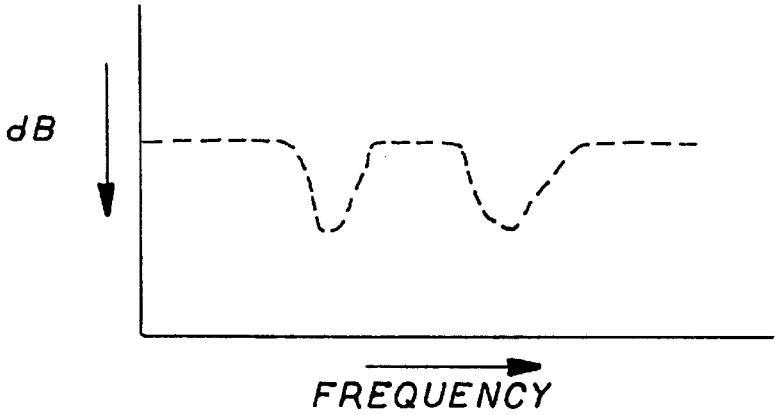
FIG.7

COMBINATION LOW OBSERVABLE AND THERMAL BARRIER ASSEMBLY

BACKGROUND OF THE INVENTION

1. Field of the Invention

The invention relates to the field of low observable structures for vehicles such as aircraft and, in particular, to a low observable structure that incorporates thermal protection.

2. Description of Related Art

The design of most radar absorption materials (RAM) used in stealth aircraft are classified. However, it is known that most make use of ferrite or graphite loaded into paints or composite materials. In fact, ferrite loaded paints for use on bridges and buildings are commercially available. For example, U.S. Pat. No. 5,312,678 "Camouflage Material" by F. P. McCullough, Jr., et al. and U.S. Pat. No. 5,094,907 "Electromagnetic Wave Absorbing Material" by T. Yamamura, et al. Furthermore, U.S. Pat. No. 6,461,432 "Ceramic Ram Film Coating Process" for making a ceramic RAM coating, although the formulation of the RAM is not disclosed. However, such RAM materials and structures do not have the capability to protect the underlying structure from fire.

Because of the fact that at any time aboard an aircraft carrier there are numerous aircraft on the deck loaded with ordinance, there is always a high risk of an explosion and fire. Thus it has been standard practice to coat the ordinance such as missiles and bombs with a thin heat resistant coating. This coating is designed to prevent the ordinance from exploding for a period of time sufficient for the ordinance to be removed to a safe location or dumped overboard.

Combining RAM material with a heat protecting barrier is old in the art. U.S. Pat. No. 4,084,161 "Heat Resistant Radar Absorber" by W. P. Manning, et al. does disclose a three-layer RAM substrate in combination with a foamed ceramic slab. The ceramic slab is made of blocks bonded together to provide the heat shield. The ceramic material is a mixture of Silicon tri0xide ($SiO_3$), Zirconium Oxide ($ZrO_2$) and Kao-wool fibers. While this material may provide radar absorption as well as thermal protection, it does not lend itself for use in complex contour parts, were not only is radar absorption and heat protection required, but shaping to reduce the radar signature. It is obvious that the use of ceramic blocks bonded to a ram substrate is not suitable for use on small highly contoured ordinance such as missiles or bombs.

Thus, it is a primary object of the invention to provide a combination heat protection and reduced radar signature assembly for protecting structures.

It is another primary object of the invention to provide a combination heat protection and reduced radar signature assembly that is easily moldable to complex contours.

It is a further object of the invention to provide a combination heat protection and reduced radar signature assembly that can be molded to low observable shapes.

It is a still further object of the invention to provide a combination heat protection and reduced radar signature assembly that can be molded to low observable shapes suitable for use on missiles and bombs.

SUMMARY OF THE INVENTION

The invention is a protective assembly for providing both thermal protection and a reduction of radar cross-section of at least a part of a structure. The structure can be a weapon such as a bomb or air to ground missile launched from an aircraft. However, it is not limited to such items and can be used in any application where thermal protection and a reduction of radar cross-section is required. An example of this is bombs carried by naval aircraft launched from aircraft carriers. As previously mentioned, it is a requirement that weapons to be loaded on aircraft have thermal protection coatings. It is also desirable that the radar cross-section of such weapons be reduced. This also has the advantage of reducing the radar-cross-section of the aircraft carrying such weapons into combat.

In general terms, a first layer of heat thermal protection material having an outer surface having a radar cross-section reducing shape and an inner surface conforming to the surface of the structure to be protected. A second layer of radar signature reducing material is bonded to the outer surface of the first layer and includes a film of conductive material bonded to the outer surface of the first layer. The film can be a metal foil or wire mesh. A film radar absorbing material is bonded to the film of conductive material. A third layer of dielectric material is bonded to the film of radar absorbing material. The third layer has a thickness selected to provide a reduction in the radar cross-section of the cover when combined with the film of radar absorbing material "tuning" the absorber such that it is effective at selective frequencies. It is also desirable that this third layer provide thermal protection.

The thickness of the third layer is critical to obtaining a reduction in the radar cross-section and must be selected to provide the proper impedance to effect the reduction in radar cross-section at the desired frequencies. The first layer is preferably made of moldable material, which allows it to be cast into the proper radar cross-section reducing shape.

If the structure is a bomb or the like, the cover maybe in three sections. A first section would the nose, while second and third sections would cover the side of the bomb. Of course, a two-section cover could be used extending from the nose to the rear thereof. Openings would have to be provided for the mounting hooks and sway braces. Tail fins would be left uncovered.

Thus it can be seen that the protective cover can provide thermal protection required, if the weapon is to be mounted on a carrier based aircraft. In addition, the radar cross-section of the weapon can be reduced.

The novel features which are believed to be characteristic of the invention, both as to its organization and method of operation, together with further objects and advantages thereof, will be better understood from the following description in connection with the accompanying drawings in which the presently preferred embodiment of the invention is illustrated by way of example. It is to be expressly understood, however, that the drawings are for purposes of illustration and description only and are not intended as a definition of the limits of the invention.

BRIEF DESCRIPTION OF THE DRAWINGS

FIG. 3 is a cross-sectional view of the Mark 80 series GP Bomb shown in FIG. 2 taken along the line 3—3.

FIG. 5 is a Joint Direct Attack Munitions (JDAM) bomb with a two piece combination low observable and thermal barrier assembly installed along the sides of the bomb and a separate radar absorbing material on the nose.

FIG. 6 is a partial cross-sectional view of a portion of the two-piece combination low observable and thermal barrier assembly.

FIG. 7 a generalized graph of the radar signature drop, in dB as a function of frequency of the incoming radar signal.

DESCRIPTION OF THE PREFERRED EMBODIMENT

It is critical abroad aircraft carriers that munitions incorporate materials to provide thermal protection to prevent their initiation during an inadvertent on board fire. The thermal protection coating must provide sufficient protection to allow time for the fire to be put out or at least controlled. It is also desirable to incorporate radar attenuation coatings on munitions. On those weapons carried externally, such coatings will reduce the overall radar signature of the aircraft. On munitions carried internally, it reduces the capability of hostile radar systems to back track the munitions to localize the launch aircraft. These two important features are combined in the subject invention.

Figure 1:
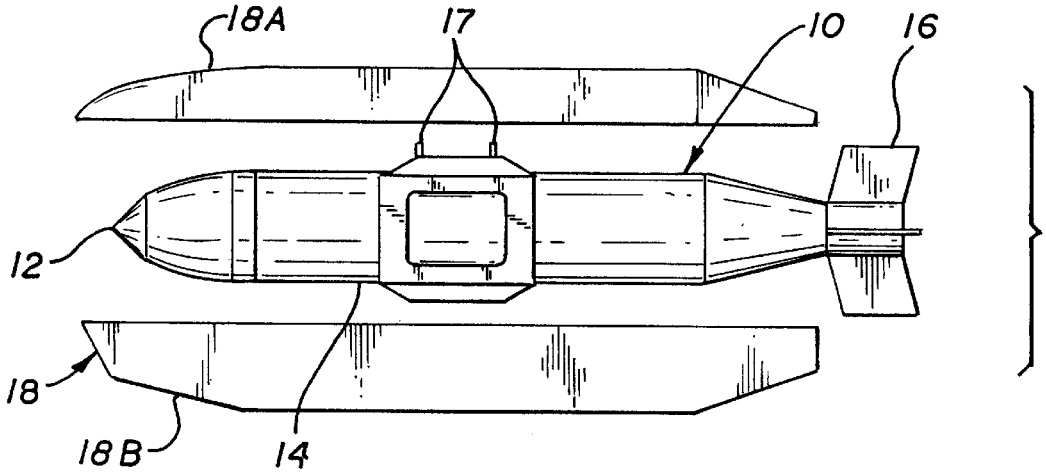
FIG. 1 is an exploded side view of a Mark 80 Series General Purpose (GP) Bomb with the combination low observable cover and thermal barrier assembly.
Figure 2:
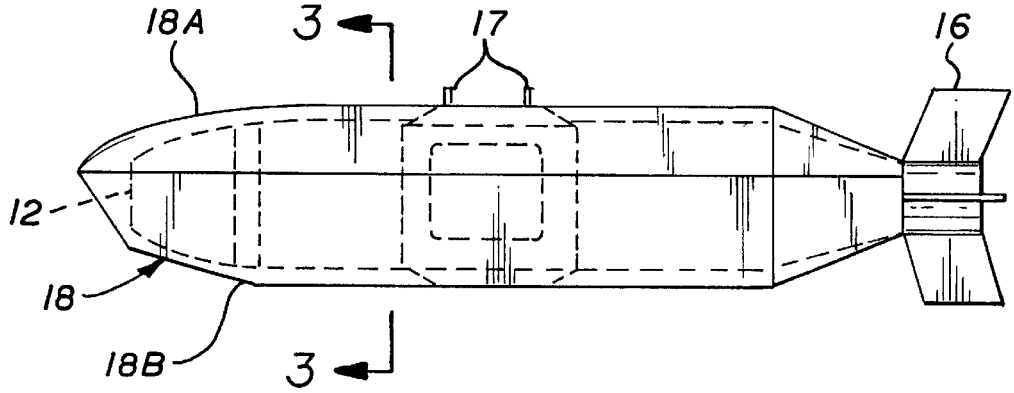
FIG. 2 is a side view of the Mark 80 Series GP Bomb with the combination low observable cover and thermal barrier assembly installed thereon.

FIGS. 1–3 illustrate a Mark 80GP Bomb, indicated by numeral 10, having a nose section 12, middle section 14 and tail fin section 16. Mounting lugs 17 protrude from the central section 14. A two piece cover assembly 18, comprising upper portion 18A and lower portion 18B, is fitted over the nose section 12 and middle section 14 of the bomb 10 with only the mounting lugs 17 protruding through the upper portion. Note that the cover assembly 18 has an external surface 20 having a shape designed to reduce the radar cross-section. For example as disclosed in U.S. Pat. No. 5,250,950 "Vehicle" by Scherrer, et al. In this patent, the use of faceted surfaces is disclosed as used on the F-117A aircraft. However, curved surfaces can also be designed to have low radar cross-sections.

Referring now to FIG. 6, the cover 18 is composed of a first or inner layer of thermal insulation 22 having an internal surface 24 conforming to the external surface 26 of the bomb 10 and an external surface 28 conforming to the external surface 20 of the cover assembly 18A. An electrically conductive film 29 is bonded to the external surface 28 of the inner layer of thermal insulation. The film 29 can be either a flexible metal foil or mesh. A radar-attenuating layer 30 is bonded to the film 29. It can a dielectric material such as resin loaded with graphite or ferrite material. For example, the dielectric material can be a silicon-based elastomer or an epoxy paint. An outer layer 32 of thermal resistant insulation is bonded over the layer 30. This is preferably identical to the inner layer of thermal insulation 22. The thickness 34 of the layer 32 is critical. The thickness 34 is selected to interact with the layer 30 to cause interference cancellation of electromagnetic radiation (radar signals). As shown in FIG. 7, by proper selection of the thickness 34, a significant drop (as measured in dB) can be obtained at selected frequencies. Because the thickness 34 of the layer 32 will most likely be insufficient to provide the necessary thermal insulation, the layer 22 becomes a necessity. Because of this fact, it can also be used to provide shaping to reduce the radar signature.

There are a number of material that can be used for the first layer 22. For example, U.S. Pat. No. 6,153,668 "Low Density Fire Barrier Material And Method Of Making" by R. E. Gestner, et al. discloses a fire barrier material making use of intumescent compounds is usable. FASTBLOCK™ manufactured by Kirkhill-TA Company Brea, Calif. is ideally suitable for this application. This proprietary material uses a silicone-based elastomer containing polymeric ceramic precursors that become ceramic materials when exposed to high heat. Another proprietary material is Min-K™ Thermal Ceramics, manufactured by The Morgan Crucible Company, Incorporated available through Resto Products, Santa Fe Springs, Calif.

Figure 4:
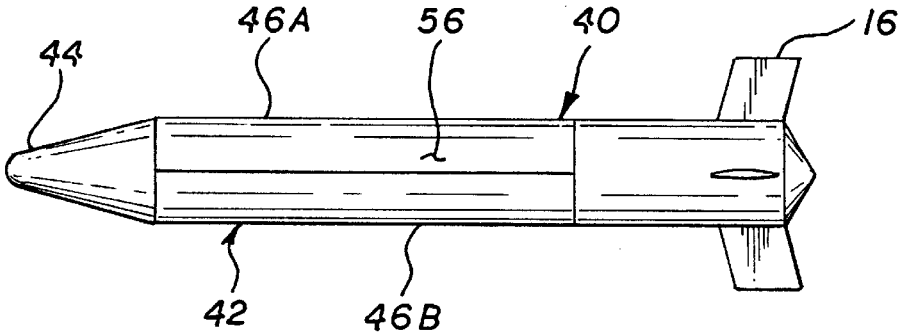
FIG. 4 is a is a bomb with a three piece combination low observable and thermal barrier assembly installed thereon.

Presented in FIG. 4 is a second embodiment of the cover assembly is illustrated. The Bomb 40 is covered with a three-piece cover assembly 42 comprising a nose cover 44, and upper and lower center section covers 46A and 46B. In FIG. 5 a JDAM bomb, indicated by numeral 48, includes a radar coating 50 on the nose 52 of the bomb 48 and upper and lower covers 54A and 54B along the center section 56.

While the invention has been described with reference to particular embodiments, it should be understood that the embodiments are merely illustrative as there are numerous variations and modifications, which may be made by those skilled in the art. Thus, the invention is to be construed as being limited only by the spirit and scope of the appended claims.

INDUSTRIAL APPLICABILITY

The invention has applicability to the aircraft industry as well as the munitions manufacturing industry.

What is claimed is:

1. A protective cover assembly having at least one part for a surface of a structure comprising:

a first layer of thermal protection material bonded to the structure, said first flexible layer having an outer surface having a radar cross-section reducing shape; and a second flexible layer of radar signature reducing material bonded to outer surface of said first flexible layer, said second flexible layer comprising:

a film of conductive material bonded to said first layer of heat v<resistant material; and a film of radar absorbing material bonded to said first flexible layer; and a third layer made of a dielectric material having a thickness selected to provide a reduction in the radar cross-section of the cover when combined with said film radar absorbing material.

2. The cover assembly as set forth in claim 1 wherein said third layer is also made of a thermal protection material.

3. The cover assembly as set forth in claim 1, or 2 wherein the structure is a bomb having a nose section, center section and tail section, and the cover comprising first and second portions adapted to cover the sides of the nose and center sections of the bomb.

4. The cover assembly as set forth in claim 3, wherein the structure is a bomb having a nose section, center section and tail section, and the cover comprising:

a first portion adapted to cover the nose section of the bomb; and a second and third portions adapted to cover the sides of the center section of the bomb.

5. The cover assembly as set forth in claim 3 wherein said first, second and third portions are adapted to fit together forming a continuous cover over the nose and center sections of the bomb.

6. A structural assembly comprising:

a structure; and a protective cover assembly having at least one part for a surface of a structure comprising a first layer of thermal protection material bonded to the structure, said first flexible layer having an outer surface having a radar cross-section reducing shape; and a second flexible layer of radar signature reducing material bonded to outer surface of said first flexible layer, said second flexible layer comprising:

a film of conductive material bonded to said first layer of heat resistant material; and a film of radar absorbing material bonded to said first flexible layer; and a third layer made of a dielectric material having a thickness selected to provide a reduction in the radar cross-section of the cover when combined with said film radar absorbing material.

7. The structural assembly as set forth in claim 6 wherein said third layer is also made of a thermal protection material.

8. The structural assembly as set forth in claim 6, or 7, wherein the structure is a bomb having a nose section, center section and tail section, and the cover assembly comprising first and second portions adapted to cover the sides of the nose and center sections of the bomb.

9. The structural assembly as set forth in claim 8, wherein the structure is a bomb having a nose section, center section and tail section, and the cover comprising:

a first portion adapted to cover the nose section of the bomb; and a second and third portions adapted to cover the sides of the center section of the bomb.

10. The structural assembly as set forth in claim 9 wherein said first, second and third portions are adapted to fit together forming a continuous cover over the nose and center sections of the bomb.

* * * * *